US009050806B2

(12) United States Patent
Sawada

(10) Patent No.: US 9,050,806 B2
(45) Date of Patent: Jun. 9, 2015

(54) LIQUID EJECTION HEAD

(75) Inventor: Etsuko Sawada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 898 days.

(21) Appl. No.: 12/870,572

(22) Filed: Aug. 27, 2010

(65) Prior Publication Data

US 2011/0050785 A1 Mar. 3, 2011

(30) Foreign Application Priority Data

Sep. 2, 2009 (JP) ..... 2009-202532

(51) Int. Cl.

*B41J 2/015* (2006.01)
*B41J 2/135* (2006.01)
*B41J 2/16* (2006.01)

(52) U.S. Cl.

CPC ..... *B41J 2/1606* (2013.01); *B41J 2/1603* (2013.01); *B41J 2/1626* (2013.01); *B41J 2/1634* (2013.01); *B41J 2/1645* (2013.01)

(58) Field of Classification Search

USPC ..... 347/20, 22, 45
See application file for complete search history.

(56) References Cited

U.S. PATENT DOCUMENTS

| | | | | |
|---|---|---|---|---|
| 5,041,588 | A * | 8/1991 | Caporiccio | 556/413 |
| 5,910,372 | A * | 6/1999 | Griffin et al. | 428/429 |
| 6,302,523 | B1 * | 10/2001 | Smith et al. | 347/45 |
| 6,364,456 | B1 * | 4/2002 | Yang et al. | 347/47 |
| 6,491,981 | B1 * | 12/2002 | Guichard et al. | 427/387 |
| 7,210,763 | B2 * | 5/2007 | Kato et al | 347/45 |
| 7,264,329 | B2 * | 9/2007 | Kato et al. | 347/20 |
| 7,270,883 | B2 * | 9/2007 | Kato | 428/421 |
| 7,594,718 | B2 * | 9/2009 | Soutar et al. | 347/95 |
| 7,758,158 | B2 * | 7/2010 | Ohkuma et al. | 347/45 |
| 8,785,556 | B2 * | 7/2014 | Brown | 525/126 |
| 2007/0085877 | A1 | 4/2007 | Ohkuma et al. | |

FOREIGN PATENT DOCUMENTS

| | | | |
|---|---|---|---|
| CN | 1771132 | A | 5/2006 |
| JP | 05-138889 | A | 6/1993 |
| KR | 10-2006-0036465 | A | 4/2006 |

* cited by examiner

*Primary Examiner* — Daniel Petkovsek
(74) *Attorney, Agent, or Firm* — Canon U.S.A. Inc., IP Division

(57) ABSTRACT

A liquid ejection head includes a member having a liquid ejection port, wherein a surface of the member on which the ejection port is open is formed by a curing reaction of a siloxane compound having a first group and a second group. The first group has a fluorine atom. The second group has at least one selected from the group consisting of a hydroxy group, a carboxy group, a carbonyl group, and a polyether structure.

4 Claims, 6 Drawing Sheets

LIQUID EJECTION HEAD

BACKGROUND OF THE INVENTION

1. Field of the Invention

The present invention relates to a liquid ejection head for ejecting liquid.

2. Description of the Related Art

An exemplary liquid ejection head is one used in an ink-jet printing method. In the ink-jet printing method, liquid droplets are ejected from ejection ports onto a recording medium, such as a sheet of paper, thereby printing images and characters.

An outer surface of an ink-jet print head on which ejection ports are open (hereinafter referred to as an "ejection surface") is subjected to liquid-repellent treatment to facilitate the removal of deposited ink, for example, with a wiper. A liquid-repellent material must therefore be resistant to ink and wiping with a rubber blade.

U.S. Patent Application Publication No. 2007/0085877 discloses an ink-jet print head having an ejection surface treated with a particular liquid-repellent compound. The liquid-repellent compound has a siloxane skeleton having a liquid-repellent perfluoroalkyl group.

The ink-jet printing method has recently been used in various fields. Accordingly, various inks have been used in various ways. A certain ink-jet print head has a heating function to improve ejection characteristics. In some cases, an ink-jet print head is not used for many hours or days. Some conditions of use accelerate the evaporation of ink solvent in the vicinity of ejection ports on an ejection surface of an ink-jet print head. This may result in an increase in the viscosity of deposited ink and the solidification of deposited ink on the ejection surface, causing deterioration in ink ejection performance. Even with an ink-jet print head having a liquid-repellent ejection surface to improve printing characteristics, the evaporation of ink solvent can lower liquid repellency. Deposited ink may distort ejected droplets, resulting in undesirable print images and characters.

SUMMARY OF THE INVENTION

In accordance with one aspect of the present invention, a liquid ejection head includes a member having a liquid ejection port, wherein an ejection surface of the member is formed by a curing reaction of a siloxane compound having a first group and a second group, the first group having a fluorine atom, the second group having at least one selected from the group consisting of a hydroxy group, a carboxy group, a carbonyl group, and a polyether structure.

Further features of the present invention will become apparent from the following description of exemplary embodiments with reference to the attached drawings.

DESCRIPTION OF THE EMBODIMENTS

Aspects of the present invention will be described in detail below.

An ink-jet print head will be described below as an example of a liquid ejection head. However, liquid ejection heads can be used in other applications, such as the manufacture of color filters, as well as ink-jet print heads.

Figure 1:
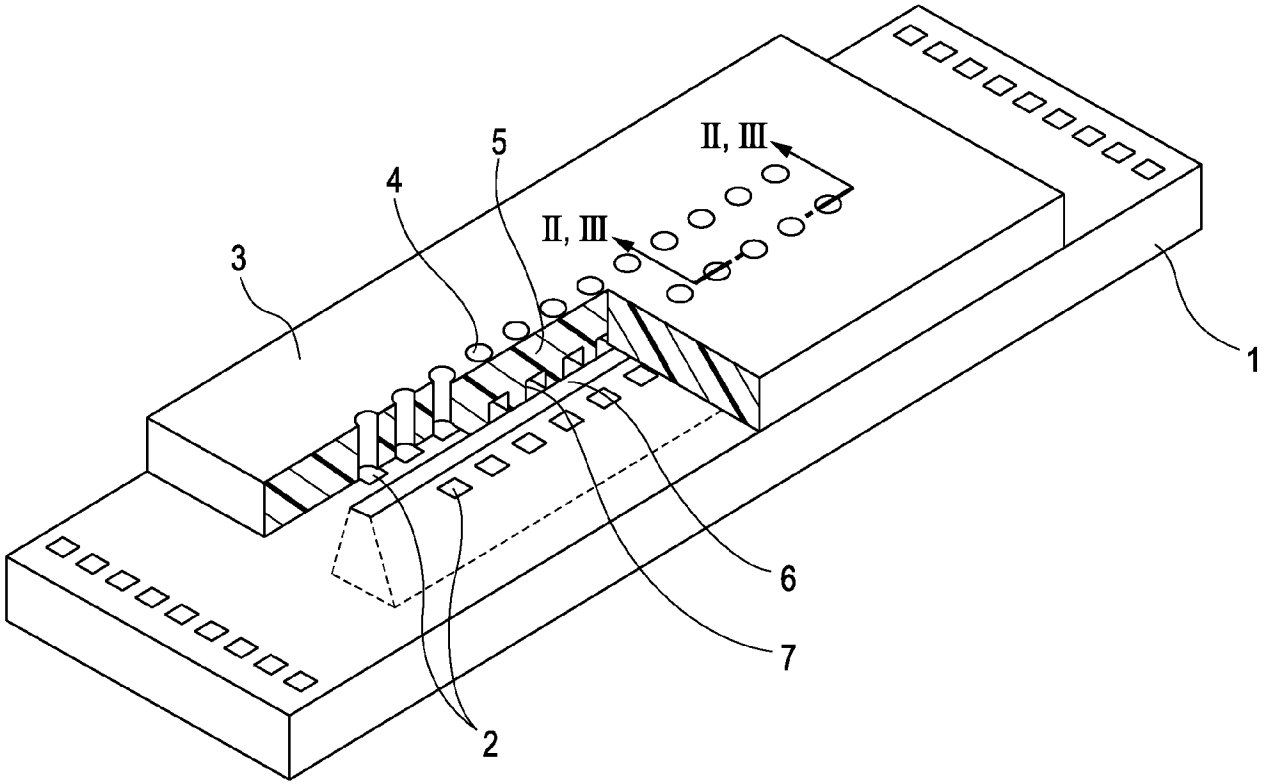
FIG. 1 is a perspective view of an ink-jet print head according to an embodiment of the present invention.

FIG. 1 is a perspective view of an ink-jet print head according to an embodiment of the present invention. The ink-jet print head includes a substrate 1 having energy-generating elements 2 and an ejection-port-forming member 5 disposed on the substrate 1. The ejection-port-forming member 5 includes a plurality of ejection ports 4 and ink passages 7. The substrate 1 further includes an ink-supply port 6, which communicates with the ejection ports 4 through the ink passages 7. Aspects of the present invention relate to a material of a liquid-repellent layer disposed on an ejection surface 3 of the ejection-port-forming member 5.

As described above, U.S. Patent Application Publication No. 2007/0085877 discloses a liquid-repellent layer of an ink-jet print head formed of a cured material containing a condensate between a fluorine-containing hydrolyzable silane compound and a hydrolyzable compound having a cationically polymerizable group. The cured material is an organic-inorganic hybrid cured material, which has an inorganic skeleton of hydrolyzable silane (a siloxane skeleton) and an organic skeleton formed by curing of the cationically polymerizable group (an ether bond in the case of an epoxy group). The liquid-repellent layer is resistant to wiping and chemicals (ink resistance). In the case that the liquid-repellent layer is formed simultaneously with the ejection-port-forming member, the liquid-repellent layer can be firmly adhered to the ejection-port-forming member.

In general, a film having a fluorine-containing group, such as a perfluoroalkyl group, has very low surface free energy and therefore has high liquid repellency in air. A film having both a fluorine-containing group and a hydrophilic group can have oil repellency in water. This is probably because the hydrophilic group is vertically oriented on the surface in water, thereby providing a hydrophilic surface.

The present inventor found that it is very effective to use a hydrophilic group in the material of a liquid-repellent layer to prevent contamination, such as deposits, on an ejection surface of an ink-jet print head and achieve high print quality. An ejection surface of an ink-jet print head is always in contact with air rather than water and is therefore required to be liquid-repellent in air. However, the evaporation of ink solvent increases the viscosity of ink on the ejection surface, possibly causing deposition of ink components. The present inventor found that non-concentrated liquid, such as fresh ink, water, or solvent, supplied to an ejection surface can redissolve ink deposits on the ejection surface by the action of a hydrophilic group and effectively maintain the cleanliness of the ejection surface.

Figure 6A:
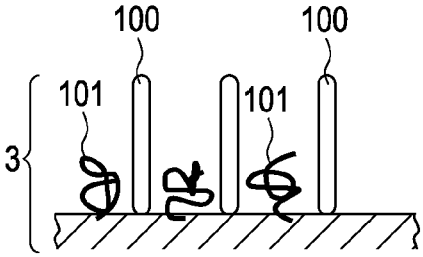
FIG. 6 is a schematic view of an ejection surface of an ink-jet print head according to an embodiment of the present invention.
Figure 6B:
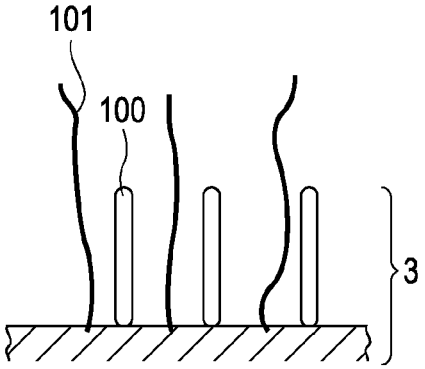

A principle of action according to aspects of the present invention will be described below with reference to FIG. 6. FIG. 6 schematically illustrates an ejection surface. In general, in order to minimize the surface free energy on an ejection surface 3 in air (a), a liquid-repellent group 100, such as a perfluoroalkyl group, is vertically oriented, and a hydrophilic group 101 is folded. On the other hand, the hydrophilic group 101 is vertically oriented in water. The oriented hydrophilic group 101 facilitates the removal of deposits on the surface.

In the following cases, a liquid component, such as water or solvent, can actually be supplied to an ejection surface of an ink-jet print head to wet the ejection surface. In a first case, ink mist adheres to an ejection surface during the subsequent printing and supplies solvent (water) to concentrated ink. In a second case, wiping supplies relatively fresh ink from the surroundings to concentrated ink. In common ink-jet print heads, excessive ink on an ejection surface is removed by wiping, for example, with a rubber blade. A third case is wet wiping. In the wet wiping, a processing liquid is adhered to a rubber blade to efficiently remove ink. The processing liquid is therefore supplied to concentrated ink. Advantages according to aspects of the present invention can be achieved when an ejection surface is wet with ink or a processing liquid. Wet wiping can therefore achieve higher advantages. An ink-jet print head according to aspects of the present invention is suitable for ink-jet printers in which an ejection surface of an ejection-port-forming member is wiped with a wet wiper.

In the manufacture of a liquid-repellent film having both a fluorine-containing group and a hydrophilic group, it is important to uniformly distribute the fluorine-containing group and the hydrophilic group. The addition of a hydrophilic resin to a fluorine-containing liquid-repellant material results in the formation of a hydrophilic domain and a hydrophobic domain separated from each other and cannot achieve the intended performance. A monomer having a fluorine-containing group and a monomer having a hydrophilic group must therefore be copolymerized. Although acrylates and methacrylates having perfluoroalkyl groups are widely used as fluorine-containing monomers, they have an ester structure having low resistance to ink, sometimes causing defects of the material, such as swelling or separation. According to aspects of the present invention, use of silane monomers successfully allows homogeneous polycondensation between a monomer having a hydrophilic group and a fluorine-containing monomer.

According to aspects of the present invention, a liquid-repellent layer is formed of a cured material formed by the polycondensation of a hydrolyzable silane compound (a) having a water-repellent hydrophobic fluorine-containing group (a first group) and a hydrolyzable silane compound (b) having a hydrophilic group (a second group) in a silane composition. Examples of the hydrophilic group include a hydroxy group, a carboxy group, a carbonyl group, and a polyether structure (a structure having two or more ether groups). The polycondensation of a hydrolyzable silane compound involves hydrolysis of a hydrolyzable group and dehydration condensation of the hydrolyzed group. Thus, a hydrophilic group must be located on a group bonded to a silicon atom of a hydrolyzable silane compound through a carbon atom, that is, on a nonhydrolyzable organic group. Thus, a hydrolyzable silane compound having a hydrophilic group is a hydrolyzable silane compound (b) having a nonhydrolyzable organic group having any of a hydroxy group, a carboxy group, a carbonyl group, and a polyether structure. The hydrolyzable silane (b) may contain a fluorine atom, provided that the hydrolyzable silane (b) can have sufficient hydrophilicity to achieve the advantages according to aspects of the present invention.

The hydrophilic group can be a hydroxy group or a polyether structure in terms of high hydrophilicity and reactivity. More specifically, the hydrophilic group can be an alkyl group having 1 to 20 carbon atoms and a hydroxy end group or a polyether structure. In particular, the hydrophilic group can be a poly(ethylene glycol) residue or a poly(propylene glycol) residue.

Specific examples of the alkyl group having 1 to 20 carbon atoms and a hydroxy end group include a hydroxyethyl group, a hydroxypropyl group, a hydroxybutyl group, a hydroxyhexyl group, a hydroxyoctyl group, a hydroxydecyl group, and a hydroxydodecyl group. Compounds having two or more hydroxy groups can have higher hydrophilicity.

The hydrolyzable silane compound (b) may be a compound having the following formula (1):

$$R_4O—(R_3O)_n—Z—Si—(OR_2)_q(R_1)_p \quad (1)$$

wherein p+q is 3, p is 0, 1, or 2, q is 1, 2, or 3, n is an integer in the range of 1 to 30, Z denotes a bivalent organic group, $R_1$ and $R_2$ independently denote a saturated or unsaturated hydrocarbon residue, $R_3$ denotes $—CH_2—$, $—CH_2CH_2—$, $—CH_2CH_2CH_2—$, or $—CH_2CH(CH_3)—$, and $R_4$ denotes H or alkyl group.

A photopolymerizable material for an ink-jet print head is capable of cationic polymerization rather than radical polymerization in terms of high ink resistance. Although there are many hydrophilic groups containing a nitrogen or sulfur atom, these groups may be difficult to use according to aspects of the present invention because they inhibit cationic polymerization.

The hydrolyzable silane compound (a) can be an alkoxysilane having an alkyl fluoride group having the following formula (2):

$$CF_3—(CF_2)_r—Z—Si—(OR_2)_q(R_1)_p \quad (2)$$

wherein p+q is 3, p is 0, 1, or 2, q is 1, 2, or 3, r is an integer in the range of 0 to 20, Z denotes a bivalent organic group, and $R_1$ and $R_2$ independently denote a saturated or unsaturated hydrocarbon residue or a hydrogen atom.

Specific examples of Z in the formula (2) include $—C_2H_4—$ and $—CH_2CH_2CH_2—$. Specific examples of a saturated or unsaturated hydrocarbon residue of $R_1$ or $R_2$ in the formula (2) include a methyl group and an ethyl group.

The variable r in the formula (2) may be 5 or more in terms of high liquid repellency and 13 or less, such as 11 or less, in terms of high solubility.

Specific examples of the hydrolyzable silane compound (a) include, but are not limited to, the following compounds:

$CF_3—C_2H_4—Si—(OR)_3$, $C_2F_5—C_2H_4—Si—(OR)_3$, $C_4F_9—C_2H_4—Si—(OR)_3$, $C_6F_{13}—C_2H_4—Si—(OR)_3$, $C_8F_{17}—C_2H_4—Si—(OR)_3$, and $C_{10}F_{21}—C_2H_4—Si—(OR)_3$.

wherein three Rs independently denote a methyl group or an ethyl group.

The hydrolyzable silane compound (a) and the hydrolyzable silane compound (b) can be combined with a hydrolyzable silane compound (c) having a cationically polymerizable group. This can yield an organic-inorganic hybrid cured material, which has an inorganic skeleton having a siloxane structure and an organic skeleton formed by curing of the cationically polymerizable group. The organic-inorganic hybrid cured material has dramatically improved durability and ink resistance.

Examples of the hydrolyzable silane compound (c) include compounds having the following formula (3):

$$R_3—Z—Si—(OR_2)_q(R_1)_p \quad (3)$$

wherein p+q is 3, p is 0, 1, or 2, q is 1, 2, or 3, Z denotes a bivalent organic group, $R_1$ and $R_2$ independently denote a saturated or unsaturated hydrocarbon residue, and $R_3$ is a cationically polymerizable organic group.

Specific examples of Z in the formula (3) include —$CH_2CH_2CH_2$—. Specific examples of a saturated or unsaturated hydrocarbon residue of $R_1$ or $R_2$ in the formula (3) include a methyl group and an ethyl group.

Examples of the cationically polymerizable organic group of $R_3$ in the formula (3) include groups having cyclic ether groups, such as an epoxy group and an oxetane group, and a vinyl ether group. The cationically polymerizable organic group can be a group having an epoxy group in terms of availability and reaction controllability. Examples of the group having an epoxy group include a glycidyl group and an epoxycyclohexyl group.

Specific examples of the hydrolyzable silane compound (c) include, but are not limited to, the following compounds:

glycidoxypropyltrimethoxysilane, glycidoxypropyltriethoxysilane, epoxycyclohexylethyltrimethoxysilane, and epoxycyclohexylethyltriethoxysilane.

The hydrolyzable silane compound (a), the hydrolyzable silane compound (b), and optionally the hydrolyzable silane compound (c) can be combined with a hydrolyzable silane compound (d) having a substituted or unsubstituted alkyl or aryl group. The hydrolyzable silane compound (d) can be used to control the physical properties of a liquid-repellent layer. Examples of the hydrolyzable silane compound (d) include compounds having the following formula (4):

$$(R_4)_r—Si—(OR_2)_s \quad (4)$$

wherein r+s is 4, r is 0, 1, 2, or 3, s is 1, 2, 3 or 4, $R_2$ independently denotes a saturated or unsaturated hydrocarbon residue, and $R_4$ independently denotes substituted or unsubstituted alkyl or aryl group.

Specific examples of a saturated or unsaturated hydrocarbon residue of $R_2$ in the formula (4) include a methyl group and an ethyl group. Specific examples of an alkyl or aryl group of $R_4$ in the formula (4) include a methyl group, an ethyl group, a propyl group, and a phenyl group.

Specific examples of the hydrolyzable silane compound (d) include, but are not limited to, the following compounds:

tetramethoxysilane, tetraethoxysilane, tetrapropoxysilane, methyltrimethoxysilane, methyltriethoxysilane, methyltripropoxysilane, ethyltrimethoxysilane, ethyltriethoxysilane, ethyltripropoxysilane, propyltrimethoxysilane, propyltriethoxysilane, propyltripropoxysilane, phenyltrimethoxysilane, phenyltriethoxysilane, phenyltripropoxysilane, diphenyldimethoxysilane, and diphenyldiethoxysilane.

The ratio of these hydrolyzable silane compounds depends on the usage conditions. The percentage of the hydrolyzable silane compound (b) in the silane composition may range from 1% to 40% by mole, such as 3% to 25% by mole. The percentage of the hydrolyzable silane compound (a) in the silane composition may range from 0.5% to 20% by mole, such as 1% to 15% by mole. An excessive amount of hydrolyzable silane compound (b) may result in insufficient liquid repellency. An excessive amount of hydrolyzable silane compound (a) may result in a nonuniform liquid-repellent layer. The ratio (molar ratio) of the hydrolyzable silane compound (b) to the hydrolyzable silane compound (a) having a fluorine-containing group may range from 0.2:1 to 5:1. The percentage of the hydrolyzable silane compound (c) in the silane composition may range from 20% to 80% by mole, such as 30% to 70% by mole.

A coating composition according to an embodiment of the present invention contains a condensate between the hydrolyzable silane compound (a), the hydrolyzable silane compound (b), and optionally the hydrolyzable silane compound (c) and the hydrolyzable silane compound (d), and may further contain a cationic polymerization initiator. The condensate can be produced by the hydrolysis and polycondensation of the hydrolyzable silane compounds in the presence of water.

A coating layer according to aspects of the present invention can be formed by applying the coating composition to a surface to be treated and curing the coating composition by light or heat. A solvent may be used in the application of the coating composition. In particular, a liquid-repellent layer of an ink-jet print head according to aspects of the present invention can be produced by forming a coating layer of the coating composition on an ejection-port-forming member and curing the coating layer.

The percentage of completion of the polycondensation reaction can be expressed by the degree of condensation. The degree of condensation is defined by the proportion of the number of functional groups condensed (the number of functional groups involved in the formation of a siloxane bond Si—O—Si) to the total number of condensable functional groups (such as an alkoxy group and a silanol group). Practically, the degree of condensation can be estimated by $^{29}$Si-NMR measurement. For a trifunctional silane compound, the degree of condensation can be estimated by the following equation. A similar equation can be applied to a bifunctional or tetrafunctional silane compound.

T0: the percentage (%) of Si atom not bonded to another silane molecule

T1: the percentage (%) of Si atom bonded to one silane molecule through an oxygen atom T2: the percentage (%) of Si atom bonded to two silane molecules through an oxygen atom T3: the percentage (%) of Si atom bonded to three silane molecules through an oxygen atom $$\text{Degree of condensation}(\%) = \frac{(T1 + 2 \times T2 + 3 \times T3) \times 100}{3 \times (T0 + T1 + T2 + T3)}$$

The degree of condensation depends on the type of hydrolyzable silane compound and the synthesis conditions. An excessively low degree of condensation may result in low compatibility with a coating resin, poor coating performance, and incomplete coverage. The degree of condensation may be 20% or more, such as 30% or more. The hydrolysis and condensation reaction can be controlled by temperature and/or pH to produce a condensate having a desired degree of condensation. An acid, an alkaline, or a metal alkoxide may be used as a catalyst to control the degree of condensation. Examples of the metal alkoxide include aluminum alkoxides, titanium alkoxides, zirconia alkoxides, and their complexes. Also, acetylacetone complexes may be used as the catalysts.

Examples of the cationic polymerization initiator include cationic photoinitiators selected from the group consisting of onium salts, borate salts, compounds having an imide structure, compounds having a triazine structure, azo compounds, and peroxides. The cationic polymerization initiator can be an aromatic sulfonium salt or an aromatic iodonium salt in terms of high sensitivity, stability, and reactivity.

A method for manufacturing an ink-jet print head according to aspects of the present invention will be described below. FIGS. 2A to 2D are schematic views illustrating a method for manufacturing an ink-jet print head according to an embodiment of the present invention. FIGS. 2A to 2D are cross-sectional views taken along the line II-II in FIG. 1.

Figure 2A:
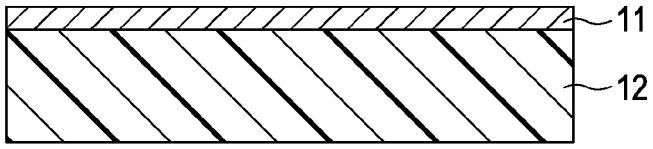
FIGS. 2A to 2D are cross-sectional views illustrating a method for manufacturing an ink-jet print head according to an embodiment of the present invention.

An ejection-port-forming member is prepared (FIG. 2A). The ejection-port-forming member is composed of a resin or SUS nozzle plate 12 and a liquid-repellent layer 11. More specifically, the above-mentioned coating composition is applied to the nozzle plate 12, for example, by dipping, spin coating, or spray coating and is cured by heat treatment or photoirradiation to form the liquid-repellent layer 11. The thickness of the liquid-repellent layer 11 depends on the usage conditions and may range from 0.1 to 2 μm.

Figure 2B:
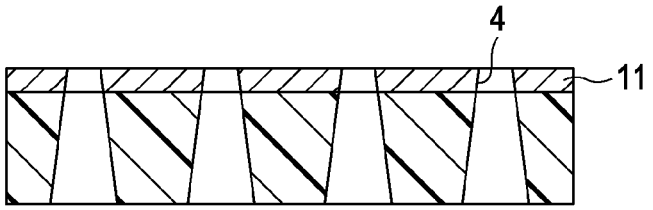

Ink nozzles 4 are then formed in the ejection-port-forming member by machining, such as excimer laser machining, pulse laser machining, or electrical ejection machining (FIG. 2B). The liquid-repellent layer 11 may be cured after the formation of the ink nozzles 4. In the machining of the ink nozzles 4, the liquid-repellent layer 11 may be covered with a protective film. With these procedures, the nozzle plate 12 and the liquid-repellent layer 11 can be machined simultaneously. This prevents the entry of a liquid-repellent material into the ink nozzles 4.

Figure 2C:
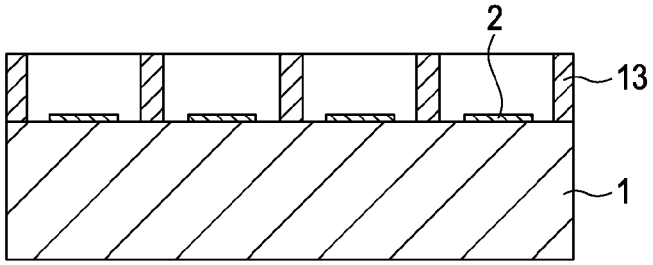
Figure 2D:
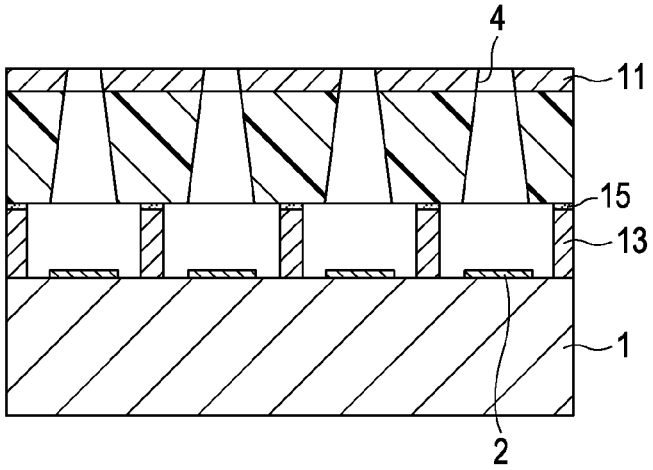

A substrate 1 is then prepared (FIG. 2C). The substrate 1 is composed of ink ejection pressure generating elements 2 and flow passage members 13. The substrate 1 is attached to the ejection-port-forming member, if necessary, using an adhesive layer 15, to fabricate an ink-jet print head (FIG. 2D).

FIGS. 3A to 3D illustrate a method for manufacturing an ink-jet print head according to another embodiment of the present invention, wherein a nozzle plate is formed of a photopolymerizable resin. FIGS. 3A to 3D are sectional views taken along the line III-III in FIG. 1.

Figure 3A:
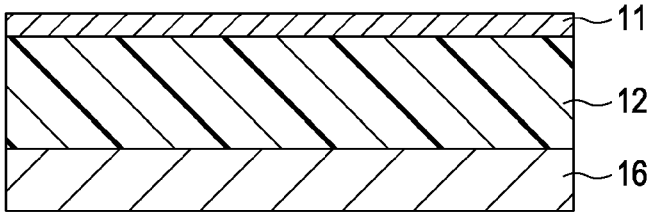
FIGS. 3A to 3D are cross-sectional views illustrating a method for manufacturing an ink-jet print head according to an embodiment of the present invention.
Figure 3B:
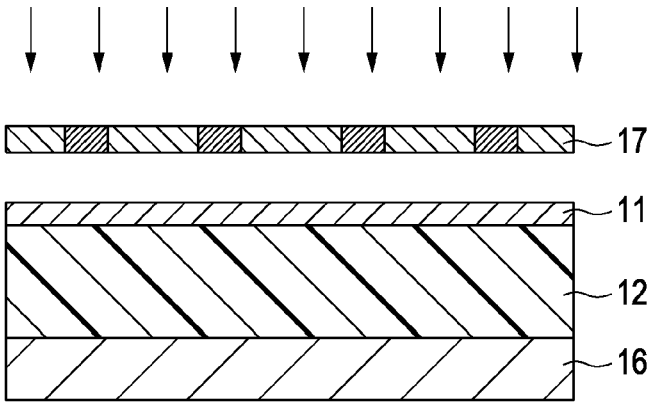
Figure 3C:
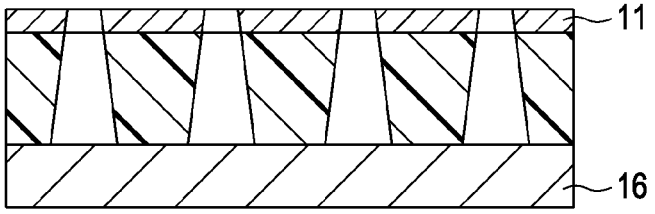
Figure 3D:
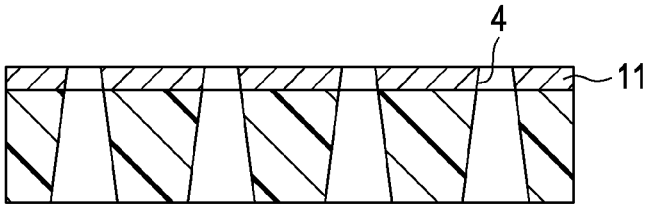

A nozzle plate 12 is formed on a support 16, and a liquid-repellent layer 11 is formed on the nozzle plate 12 (FIG. 3A). The nozzle plate 12 and the liquid-repellent layer 11 constitute an ejection-port-forming member. More specifically, the above-mentioned coating composition is applied to the nozzle plate 12, for example, by dipping, spin coating, or spray coating and is irradiated with light through a pattern mask 17 (pattern exposure) (FIG. 3B). Uncured portions of the nozzle plate 12 and the liquid-repellent layer 11 are removed by development to form ejection ports 4 (FIG. 3C). After the ejection-port-forming member is removed from the support 16 (FIG. 3D), an ink-jet print head is fabricated in the same manner as illustrated in FIG. 2.

Aspects of the present invention are applied to a method for manufacturing an ink-jet print head involving the following steps (FIGS. 4A to 4F and FIGS. 5G to 5K).

- A step of forming an ink passage pattern with a soluble resin on a substrate on which ink ejection pressure generating elements are formed.
- A step of forming a coating resin layer formed of a polymerizable coating resin on the ink passage pattern. The coating resin layer serves as ink passage walls.
- A step of forming a liquid-repellent layer on the coating resin layer.
- A step of forming ejection ports in the coating resin layer and the liquid-repellent layer on the ink ejection pressure generating elements.
- A step of dissolving out the ink passage pattern.

Figure 4A:
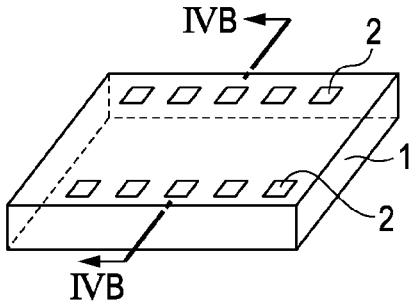
FIG. 4A is a perspective view and FIGS. 4B to 4F are cross-sectional views illustrating a method for manufacturing an ink-jet print head according to an embodiment of the present invention.
Figure 4B:
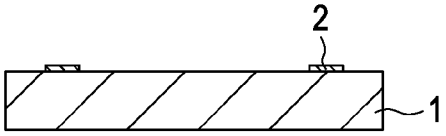
Figure 4C:
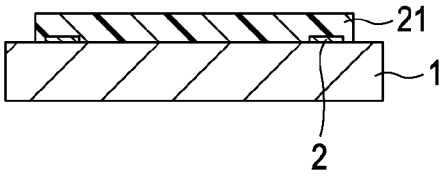

First, a substrate 1 on which ink ejection pressure generating elements 2 are formed is prepared. See FIG. 4A (a perspective view) and FIG. 4B (a cross-sectional view taken along the line IVB-IVB in FIG. 4A). An ink passage pattern 21 is formed with a soluble resin on the substrate 1 (FIG. 4C). The ink passage pattern 21 can be formed of a positive resist. In particular, a photolytic positive resist having a relatively high molecular weight can be used to prevent deformation while a nozzle material is applied to the ink passage pattern 21 in the subsequent step.

Figure 4D:
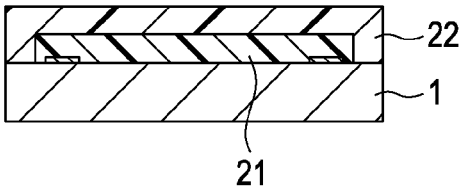
Figure 4E:
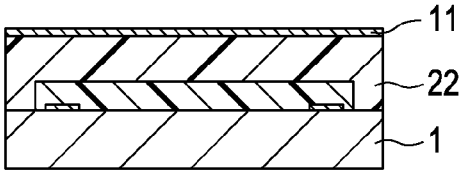

A coating resin layer 22 is then formed on the ink passage pattern 21 (FIG. 4D). A liquid-repellent layer 11 is formed on the coating resin layer 22 (FIG. 4E). The coating resin layer 22 is formed of a material that can start polymerization when light or thermal energy is supplied. The material can be a cationically photopolymerizable material. In this case, the material contains a cationic polymerization initiator as an essential component. The liquid-repellent layer 11 is formed of the above-mentioned coating composition. As described above, this coating composition does not necessarily contain a cationic polymerization initiator and may be cured with an acid produced while the coating resin layer 22 is cured. The coating resin layer 22 and the liquid-repellent layer 11 can be formed by spin coating, die coating, or slit coating. In particular, the liquid-repellent layer 11 can be formed by slit coating.

Figure 4F:
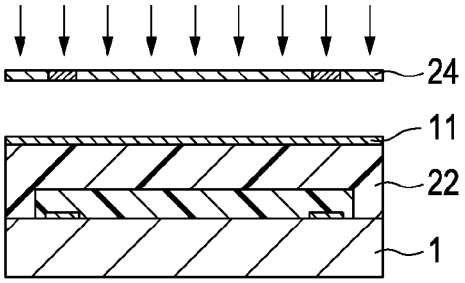
Figure 5G:
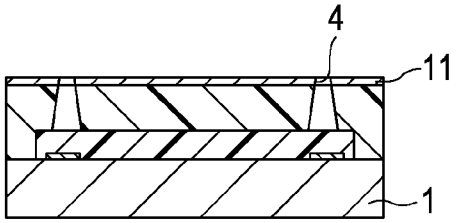
FIGS. 5G to 5K are cross-sectional views illustrating a method for manufacturing an ink-jet print head according to an embodiment of the present invention.
Figure 5H:
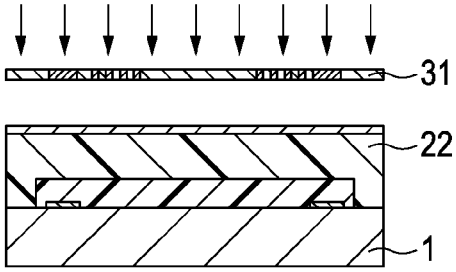

Pattern exposure through a mask 24 (FIG. 4F) and development form ejection ports 4 (FIG. 5G).

Figure 5I:
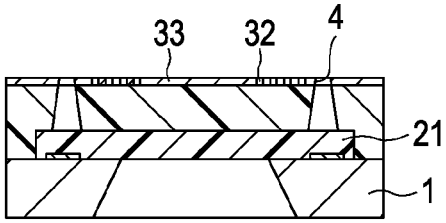

The mask pattern and the pattern exposure conditions can be appropriately determined such that the liquid-repellent layer 11 corresponding to a portion other than the ejection ports 4 is partly removed. Pattern exposure through a mask 31 having a mask pattern below a limiting resolution (FIG. 5H) and development allow partial removal of the liquid-repellent layer 11 (FIG. 5I). The term "limiting resolution", as used herein, refers to a pattern with which the coating resin layer 22 is not developed to the substrate 1. As described above, a liquid-repellent layer according to aspects of the present invention has excellent liquid repellency. Wiping may therefore cause ink droplets to be rolled into ejection ports, resulting in misfiring. In order to prevent misfiring, an ejection surface of the ejection-port-forming member includes a liquid-repellent region 33 and a region having no liquid repellency 32. In accordance with aspects of the present invention, a pattern in which the liquid-repellent layer 11 is partially absent can be easily formed as described above, thereby preventing misfiring.

Figure 5J:
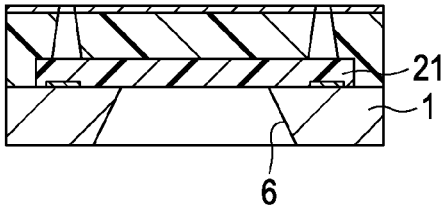
Figure 5K:
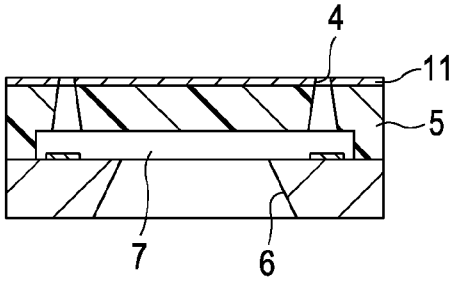

If necessary, an ink-supply port is then formed in the substrate 1 (FIG. 5J) to dissolve out the ink passage pattern 21 (FIG. 5K). If necessary, the materials of the coating resin layer 22 and the liquid-repellent layer 11 are completely cured by heat treatment to form the ejection-port-forming member 5, thus completing the ink-jet print head.

Although the coating resin layer 22 is formed of a cationically photopolymerizable material in the present embodiment, the coating resin layer 22 may be formed of a thermosetting cationically polymerizable material. In this case, after the formation of the liquid-repellent layer 11, instead of pattern exposure, excimer laser can be used to remove the coating resin layer 22 and the liquid-repellent layer 11 by ablation, forming the ejection ports 4.

EXAMPLES

Synthesis Example 1

The following components were agitated in a flask at room temperature, and were heated under reflux for 24 hours, yielding a hydrolyzable condensate.

| | |
|---|---|
| γ-glycidoxypropyltriethoxysilane | 28 g (0.1 mol) |
| Methyltriethoxysilane | 14 g (0.08 mol) |
| Tridecafluoro-1,1,2,2-tetrahydrooctyltriethoxysilane | 6.6 g (0.013 mol) |

-continued

| | |
|---|---|
| Compound 1 (represented by formula (5)) $CH_3(OCH_2CH_2)nCH_2CH_2CH_2Si(OCH_3)_3$ (5) (wherein n is an integer in the range of 10 to 30, and n is approximately 20 on an average) | 11 g (0.01 mol) |
| Water | 17.3 g |
| Ethanol | 37 g |

The hydrolyzable condensate was diluted with 2-butanol/ethanol to a solid content of 7% by weight to prepare a composition 1 for use in the formation of a liquid-repellent layer.

0.2 g of aromatic sulfonium hexafluoroantimonate salt (trade name: SP-172, manufactured by ADEKA Co.) was added to 100 g of the composition 1 as a cationic photoinitiator to prepare a composition 2 for use in the formation of a liquid-repellent layer.

Table 1 shows the proportions of silane compounds used in the synthesis of the siloxane compound. The term "fluorine-containing group" refers to silane having a fluorine-containing group, the term "cationically polymerizable group" refers to silane having a cationically polymerizable group, and the term "hydrophilic group" refers to silane having a hydrophilic group.

Synthesis Examples 2 to 5 and Comparative Synthesis Example 1

Compositions 2 for use in the formation of a liquid-repellent layer were prepared under the same conditions as in Synthesis Example 1 except that the silane compounds were used at the proportions listed in Table 1.

TABLE 1

Proportions of silane compounds in Synthesis Examples 1 to 5 and Comparative Synthesis Example 1

| | Hydrolyzable silane compound (mol) | | | |
|---|---|---|---|---|
| | Fluorine-containing group | Cationically polymerizable group | Hydrophilic group | Others |
| Synthesis Example 1 | FTS-5 (0.013) | GPTES (0.1) | Compound 1 (0.01) | MTES (0.08) |
| Synthesis Example 2 | FTS-9 (0.004) | GPTES (0.09) | Compound 1 (0.01) | MTES (0.09) |
| Synthesis Example 3 | FTS-9 (0.004) | GPTES (0.1) | Compound 1 (0.01) | PhTES (0.05) |
| Synthesis Example 4 | FTS-9 (0.004) | GPTES (0.08) | Compound 2 (0.01) | MTES (0.08) |
| Synthesis Example 5 | FTS-5 (0.004) | GPTES (0.08) | Compound 1 (0.02) | MTES (0.08) |
| Comparative Synthesis Example 1 | FTS-5 (0.013) | GPTES (0.1) | — | MTES (0.1) |

FTS-5: tridecafluoro-1,1,2,2-tetrahydrooctyltriethoxysilane
FTS-9: 2-(perfluorodecyl)ethyltriethoxysilane
GPTES: γ-glycidoxypropyltriethoxysilane
TEOS: tetraethoxysilane
MTES: methyltriethoxysilane
PhTES: phenyltriethoxysilane Compound 1: $CH_3(OCH_2CH_2)nCH_2CH_2CH_2Si(OCH_3)_3$ (wherein n is an integer in the range of 10 to 30, and n is approximately 20 on an average)

Compound 2: $H(OCH_2CH_2)nCH_2CH_2CH_2Si(OCH_3)_3$ (wherein n is an integer in the range of 10 to 30, and n is approximately 20 on an average)

Comparative Synthesis Example 2

A flask was filled with 24 g of (heptadecafluoro-1,1,2,2-tetrahydrodecyl)acrylate, 16 g of hydroxyethyl methacrylate, and 360 g of isopropanol. Air in the flask was sufficiently replaced with nitrogen. 0.1 g of 2,2-azobisisobutyronitrile (AIBN) was added to the mixture. The mixture was heated to 60° C. The mixture was further heated to 70° C. 0.01 g of AIBN was added to the mixture at 30 minutes and one hour later. The reaction was continued for additional six hours. The resulting polymer was reprecipitated in n-hexane to yield 30 g of a white powder.

Example 1

The composition 2 prepared in Synthesis Example 1 was applied to a silicon wafer by spin coating and was heated at 90° C. for one minute to evaporate the solvent. The composition 2 was irradiated with light in a UV irradiation apparatus and was heated at 90° C. for four minutes to be cured by cationic photopolymerization. The composition 2 was further heated at 200° C. for one hour in an oven to complete the curing reaction, thus forming a liquid-repellent layer.

Examples 2 to 5 and Comparative Example 1

Liquid-repellent layers were formed in the same way as in Example 1 except that the composition 2 prepared in Synthesis Example 1 was replaced with the composition 2 prepared in Synthesis Examples 2 to 5 and Comparative Synthesis Example 1.

Comparative Example 2

40 g of cyclohexanone and 0.5 g of a polymerization initiator IRGACURE 907 (manufactured by Ciba Japan K.K.) were added to 10 g of the powder prepared in Comparative Synthesis Example 1 to prepare a resist solution. The resist solution was applied to a silicon wafer by spin coating and was head at 70° C. for one minute to evaporate the solvent. The resist was irradiated with light in a UV irradiation apparatus and was heated at 90° C. for four minutes to be cured by cationic photopolymerization. The resist was further heated at 200° C. for one hour in an oven to complete the curing reaction, thus forming a liquid-repellent layer.

Evaluation Methods

In order to evaluate liquid repellency, the static contact angle of water droplets on a liquid-repellent layer was measured with a contact angle meter (initial contact angle).

In order to simulate ink contamination, a dye ink (trade name: BCI-7C) manufactured by CANON KABUSHIKI KAISHA was applied to a liquid-repellent layer. The liquid-repellent layer was placed in a thermo-hygrostat at a temperature of 60° C. and a humidity of 90% for one week to evaporate water in the ink. The ink was again applied to the liquid-repellent layer. After wiping with a urethane rubber blade, the static contact angle of water droplets was measured with the contact angle meter (contact angle after drying test).

Table 2 shows the results.

TABLE 2

| | Pure water contact angle (°) | |
|---|---|---|
| | Initial | After drying test |
| Example 1 | 92 | 78 |
| Example 2 | 102 | 85 |
| Example 3 | 99 | 82 |
| Example 4 | 96 | 84 |
| Example 5 | 95 | 81 |

TABLE 2-continued

| | Pure water contact angle (°) | |
|---|---|---|
| | Initial | After drying test |
| Comparative Example 1 | 95 | 55 |
| Comparative Example 2 | 108 | 60 |

The results show that a liquid-repellent layer according to aspects of the present invention is highly resistant to contamination in the presence of water even under conditions where a component, such as an ink component, is easily adhered (after a drying test), and maintains liquid repellency.

Example 6

An ink-jet print head was fabricated in accordance with the procedures illustrated in FIGS. 4 and 5.

First, poly(methyl isopropenyl ketone) (Tokyo Ohka Kogyo Co., Ltd., trade name: ODUR-1010) was applied to a silicon substrate by spin coating. The silicon substrate included electrothermal transducers as ink ejection pressure generating elements thereon. After prebaking at 120° C. for six minutes, the pattern exposure of ink passages was performed with a mask aligner (trade name: UX3000) manufactured by Ushio Inc. Development was performed with a mixed solvent of methyl isobutyl ketone/propylene glycol monomethyl ether acetate. After the development, the soluble resin layer had a thickness of 16 μm. Poly(methyl isopropenyl ketone) is a positive resist and can be decomposed and become soluble in an organic solvent by UV irradiation. A pattern 21 formed of a soluble resin is not exposed to light during the pattern exposure to reserve ink passages (FIG. 4C).

A cationically photopolymerizable resin composition shown in Table 3 was dissolved in a methyl isobutyl ketone/xylene mixed solvent at a concentration of 55% by weight. The solution was applied to the soluble resin layer of the ink passage pattern 21 by spin coating and was prebaked at 90° C. for three minutes to form a coating resin layer 22 (FIG. 4D). The coating resin layer 22 on the ink passage pattern 21 had a thickness of 25 μm.

TABLE 3

| Components | Manufacturer, Trade name | Proportions |
|---|---|---|
| Epoxy resin | Daicel Chemical Industries, Ltd., EHPE-3150 | 100 mass parts |
| Additive | Central Glass Co., Ltd., 1,4-HFAB | 20 mass parts |
| Cationic photoinitiator | ADEKA Co., SP-172 | 5 mass parts |
| Silane coupling agent | Shin-Etsu Chemical Co., Ltd., KBM-403 | 5 mass parts |

1,4-HFAB: (1,4-bis(2-hydroxyhexafluoroisopropyl)benzene)

The composition 1 prepared in Synthesis Example 1 was applied to the coating resin layer 22 by direct coating. Prebaking at 90° C. for one minute formed a liquid-repellent layer 11 having a thickness of 0.5 μm (FIG. 4E).

Pattern exposure of ink nozzles 4 was performed with a mask aligner (trade name: MPA600 super) manufactured by CANON KABUSHIKI KAISHA (FIG. 4F). Heating at 90° C. for four minutes, development with methyl isobutyl ketone (MIBK)/xylene=2/3, and rinsing with isopropyl alcohol formed an ejection port pattern. An exposed portion of the liquid-repellent layer 11 was cured with a cationic photoinitiator in the coating resin layer 22, forming the ejection port pattern. Since the ejection port pattern was formed integrally with the coating resin layer 22, the ejection port pattern had sharp edges (FIG. 5G).

A mask for an ink-supply port 4 was placed on the back side of the substrate. The silicon substrate was anisotropically etched to form the ink-supply port 6 (FIG. 5J). During the anisotropic etching, the ejection surface of the substrate was protected with a rubber film.

The rubber protective film was removed after the anisotropic etching. The entire surface of the substrate was then irradiated with UV light in a mask aligner (trade name: UX3000) manufactured by Ushio Inc. to decompose the soluble resin layer of the ink passage pattern. The substrate was immersed in methyl lactate for one hour while an ultrasonic wave was applied to dissolve out the ink passage pattern 21. Heat treatment at 200° C. for one hour completely cured the coating resin layer 22 and the liquid-repellent layer 11, thus forming an ejection-port-forming member 5 (FIG. 5K).

Finally, the ink-supply port 6 was attached to an ink-supply member (not shown) to complete the ink-jet print head.

Printing with the ink-jet print head filled with an ink (trade name: BCI-7C) manufactured by CANON KABUSHIKI KAISHA produced high-quality images and characters.

The ink-jet print head with ink adhered to the ejection surface was placed in a thermo-hygrostat at a temperature of 60° C. and a humidity of 90% for one week to evaporate water in the ink. After that, wiping with a urethane rubber blade was repeatedly performed during printing operation. Printing after wiping produced high-quality images and characters comparable to those produced before the drying test.

The results demonstrated that the ejection surface 3 of the liquid-repellent layer 11 according to aspects of the present invention was highly resistant to contamination.

Thus, aspects of the present invention provide a liquid ejection head having an ejection surface from which deposits can be easily removed even when the ejection surface tends to be dried. Thus, the liquid ejection head can have excellent ejection performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-202532 filed Sep. 2, 2009, which is hereby incorporated by reference herein in its entirety.

What is claimed is:

1. A liquid ejection head comprising:

a member having a liquid ejection port, wherein a surface of the member on which the ejection port is open is formed by a condensate of a composition containing a first silane compound having a hydrophilic group, the first silane compound represented by the following formula (1), and a second silane compound having a hydrophobic group, the second silane compound represented by the following formula (2):

$$R_4O—(R_3O)_n—Z—Si—(OR_2)_q(R_i)_p \quad (1)$$

wherein p +q is 3, p is 0, 1, or 2, q is 1, 2, or 3, n is an integer in the range of 1 to 30, Z denotes a bivalent organic group, $R_1$ and $R_2$ independently denote a saturated or unsaturated hydrocarbon residue, $R_3$ denotes $—CH_2—$, $—CH_2CH_2—$, $—CH_2CH_2CH_2—$, or $—CH_2CH(CH_3)—$, and $R_4$ denotes H or alkyl group, $$CF_3—(CF_2)_r—Z—Si—(OR_2)_q(R_1)_p \quad (2)$$

wherein p +q is 3, p is 0, 1, or 2, q is 1, 2, or 3, r is an integer in the range of 0 to 20, Z denotes a bivalent organic group, and $R_1$ and $R_2$ independently denote a saturated or unsaturated hydrocarbon residue or a hydrogen atom; and wherein the silane composition contains 1-40mol % of the silane compound represented by the formula (1), and 0.5-20mol % of the silane compound represented by the formula (2).

2. The liquid ejection head according to claim 1, wherein r is an integer in the range of 5 to 13.

3. The liquid ejection head according to claim 1, wherein the composition further contains a third silane compound having a cationically polymerizable group.

4. The liquid ejection head according to claim 3, wherein third silane comopund has the following formula (3):

$$R_3—Z—Si—(OR_2)_q(R_1)_p \quad (3)$$

wherein p +q is 3, p is 0, 1, or 2, q is 1, 2, or 3, Z denotes a bivalent organic group, $R_1$ and $R_2$ independently denote a saturated or unsaturated hydrocarbon residue, and $R_3$ is a cationically polymerizable organic group.

* * * * *